US009591733B1

(12) United States Patent
Koltun et al.

(10) Patent No.: US 9,591,733 B1
(45) Date of Patent: Mar. 7, 2017

(54) DRUM ASSEMBLY HAVING INTERNAL LIGHTNING DISCHARGE CAPABILITY

(71) Applicant: Drew M. Koltun, San Diego, CA (US)

(72) Inventors: Drew M. Koltun, San Diego, CA (US); Jonathan Daniel Driscoll, La Jolla, CA (US); Travis Joseph Wong, La Jolla, CA (US)

(73) Assignee: Drew M. Koltun, San Diego, CA (US)

( * ) Notice: Subject to any disclaimer, the term of this patent is extended or adjusted under 35 U.S.C. 154(b) by 0 days.

(21) Appl. No.: 14/971,929

(22) Filed: Dec. 16, 2015

(51) Int. Cl.
*G10H 3/00* (2006.01)
*H05B 41/44* (2006.01)
*G10D 13/02* (2006.01)

(52) U.S. Cl.
CPC ..... *H05B 41/44* (2013.01); *G10D 13/02* (2013.01)

(58) Field of Classification Search
CPC ..... H02J 5/005; H02J 17/00; H01J 37/241; H01J 2237/2449; G10K 9/12; H04R 1/42; H04R 23/004
See application file for complete search history.

(56) References Cited

U.S. PATENT DOCUMENTS 3,550,497 A 12/1970 Marsh
3,719,857 A 3/1973 Sharp
4,843,627 A 6/1989 Stebbins
6,933,819 B1 * 8/2005 Koonce ..... A61N 5/00 335/296
7,271,328 B2 9/2007 Pangrle
7,408,109 B1 * 8/2008 Freitas ..... G10H 3/12 84/687
7,501,571 B2 3/2009 Forsman et al.
8,563,843 B1 * 10/2013 Shemesh ..... G10H 7/00 84/723
2005/0172785 A1 8/2005 Fisher-Robbins et al.
2006/0021495 A1 * 2/2006 Freitas ..... G10H 3/12 84/723
2006/0219092 A1 * 10/2006 Mishima ..... G10H 1/0008 84/724
2008/0127804 A1 6/2008 Lashbrook et al.
2008/0284506 A1 * 11/2008 Messer ..... H03F 3/2173 327/560
2008/0297293 A1 * 12/2008 Koonce ..... H01F 5/00 335/296
2009/0134711 A1 * 5/2009 Issa ..... H01Q 7/00 307/104
2015/0009417 A1 1/2015 Jargiello, III

* cited by examiner

*Primary Examiner* — Marlon Fletcher
(74) *Attorney, Agent, or Firm* — Roeder & Broder LLP; James P. Broder

(57) ABSTRACT

A drum assembly includes a drum, a stimulus processor assembly and a Tesla coil. The stimulus processor assembly receives a stimulus, generates an input signal, and converts the input signal to an output signal. The Tesla coil receives the output signal from the stimulus processor assembly. The Tesla coil emits an electrical discharge in response to the output signal. The electrical discharge occurs at least partially within the drum interior. The stimulus processor assembly uses a conversion algorithm to convert the input signal to an output signal. The Tesla coil can be positioned inside or outside of a drum interior of the drum. A discharge router can send the electrical discharge from the Tesla coil to the drum interior. The electrical discharge can have an intensity that is correlative to the decibel level of the stimulus. The stimulus can be generated by the drum or by a source remote from the drum.

20 Claims, 6 Drawing Sheets

| Gas | Discharge Color |
|---|---|
| Helium | Pink |
| Neon | Red |
| Argon | Purple |
| Krypton | Blue |
| Xenon | Purple/White |
| Xenon/Nitrogen | Green |

DRUM ASSEMBLY HAVING INTERNAL LIGHTNING DISCHARGE CAPABILITY

BACKGROUND

Musical events have provided entertainment to avid music aficionados for centuries. In the past several decades, musical performers have increased the visual showmanship of their concerts to better entertain their fans. For example, large screens have been added behind the bands, showing the individual musicians up close while performing, and providing thematic videos during concerts. Multi-colored spotlights are commonly used to highlight a specific band member's musical prowess. Further, various props are often used to keep the attention of the enthusiast attendees. As technology steadily advances, the nature of the visual aids utilized during such performances likewise becomes increasingly more complex.

SUMMARY

The present invention is directed toward a drum assembly. In various embodiments, the drum assembly includes a drum, a stimulus processor assembly and a Tesla coil. The drum includes a drum shell that at least partially defines a drum interior. The stimulus processor assembly receives a stimulus, generates an input signal, and converts the input signal to an output signal. The Tesla coil receives the output signal from the stimulus processor assembly. The Tesla coil emits an electrical discharge in response to the output signal. The electrical discharge occurs at least partially within the drum interior.

In certain embodiments, the stimulus processor assembly includes a controller that converts the input signal to the output signal using a conversion algorithm.

In some embodiments, the Tesla coil can be positioned within the drum interior.

Alternatively, the Tesla coil can be positioned outside of the drum interior.

In various embodiments, the drum assembly also includes a discharge router that routes at least a portion of the electrical discharge from the Tesla coil to the drum interior.

In certain embodiments, the Tesla coil emits the electrical discharge only when the input signal has a voltage amplitude that exceeds a predetermined threshold level.

In some embodiments, the electrical discharge has an intensity that is correlative to the decibel level of the stimulus.

In various embodiments, the stimulus can be generated by one or more drums.

In alternative embodiments, the stimulus can be generated remotely from the drum.

In some embodiments, the stimulus can be generated by a musical instrument digital interface input.

In various applications of the drum assembly, the electrical discharge has an intensity that is correlative to at least one of a pulse width and a frequency of the output signal.

In certain embodiments, the electrical discharge is emitted substantially entirely within the drum interior.

In some embodiments, the stimulus processor assembly includes a transducer.

In various embodiments, the drum assembly includes a discharge target positioned within the drum interior, the discharge target being configured to be struck by at least a portion of the electrical discharge.

In certain embodiments, the input signal is an analog signal, and the output signal is a digital signal.

The present invention is also directed toward a method comprising the steps of generating an input signal from a stimulus with a stimulus processor assembly; converting the input signal to an output signal with the stimulus processor assembly; transmitting the output signal to a Tesla coil; and emitting an electrical discharge from the Tesla coil at least partially into a drum interior of a drum.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a drum assembly. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same or similar reference indicators will be used throughout the drawings and the following detailed description to refer to the same or like parts.

In the interest of clarity, not all of the routine features of the implementations described herein are shown and described. It will, of course, be appreciated that in the development of any such actual implementations, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
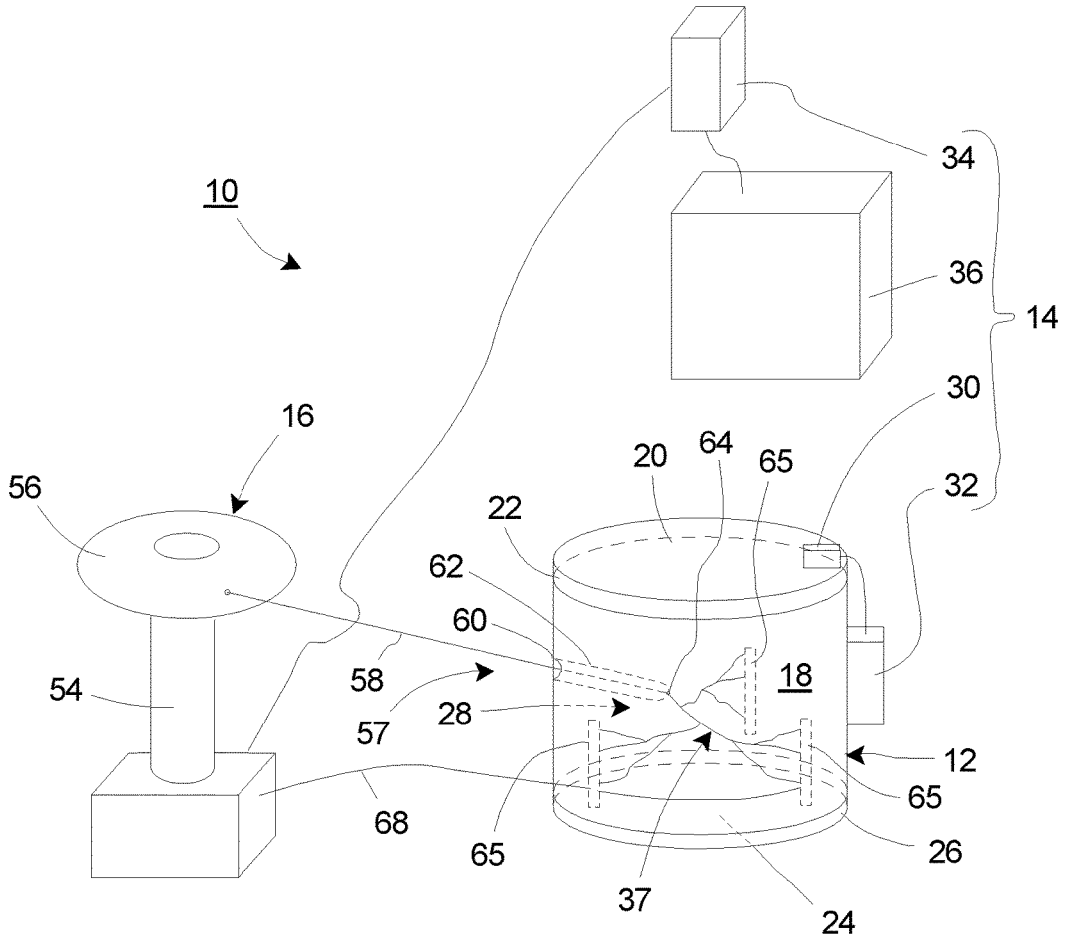
FIG. 1 is a simplified schematic illustration of one embodiment of a drum assembly having features of the present invention, including a drum and a controller.

FIG. 1 is a simplified schematic illustration of one embodiment of a drum assembly 10. In this embodiment, the drum assembly 10 includes one or more musical drums 12 (also referred to herein simply as a "drum") that are often part of a musical drum kit, a stimulus processor 14, and one or more Tesla coils 16 (only one Tesla coil 16 is illustrated in FIG. 1). In various embodiments, the drum(s) 12 being hit or otherwise struck (e.g. by a drumstick or other implement) generate a stimulus (or stimuli) in the form of sound and/or vibration that is transmitted to the stimulus processor 14 for processing as described in greater detail below. In the embodiments where the drum 12 generates the stimulus, the drum 12 can also be referred to as a stimulus generator 17. In alternative embodiments, other devices can generate the stimulus or stimuli, such as a musical instrument digital interface (MIDI) drum pad, input or file, in which case those other devices can be referred to as the stimulus generator 17, as described in greater detail below.

The size, shape and type of the drum(s) 12 (only one drum 12 is illustrated in FIG. 1), can vary depending upon the specific design requirements of the drum assembly 10. For example, the teachings provided herein can be equally utilized with a snare drum, a bass drum, a tom, or any other suitable type of drum 12. Further, although the description provided herein is particularly suited toward a drum assembly 10 having one or more drums 12, it is recognized that the teachings provided herein can equally apply to other suitable types of musical instrument assemblies. In addition, it is also recognized that certain embodiments of the drum assembly 10 can include additional features not shown and/or described herein, or can omit various features shown or described herein. Moreover, multiple drum assemblies 10, each having the features described herein, can be utilized concurrently.

In certain embodiments, the drum 12 can include one or more of a drum shell 18, a top head 20 (also sometimes referred to herein as a "first head"), a top hoop 22 (also sometimes referred to herein as a "first hoop"), a bottom head 24 (also sometimes referred to herein as a "second head"), and a bottom hoop 26 (also sometimes referred to herein as a "second hoop"). It is understood that as used herein, either head 20, 24 can be the first head or the second head. It is further understood that as used herein, either hoop 22, 26 can be the first hoop or the second hoop. It is recognized that many drums 12 include other features than those specifically identified and described herein. The drums illustrated in the Figures are intended to be representative of any suitable drum that may be used in any drum kit (or by itself) normally used by musicians.

The drum 12 also includes a drum interior 28 that can be defined and/or bounded partially or fully by one or more of the drum shell 18, the top head 20 and the bottom head 24. In one embodiment, the drum shell 18 can have a substantially cylindrical configuration. Alternatively, the drum shell 18 can have other suitable polygonal geometries or other configurations. Further, in certain embodiments, the drum shell 18 can be clear or see-through. Although the drum shell 18 may have any suitable color, in various embodiments, the drum shell 18 is substantially transparent to a light source. In some embodiments, the drum shell 18 is formed from one or more acrylics or other plastics. Still alternatively, the drum shell 18 can be formed from any other suitable material, provided that at least part of the drum shell 18 is at least partially transparent to light.

In one embodiment, the top head 20 is secured or coupled to the drum shell 18 with the top hoop 22. The bottom head 24 is secured or coupled to the drum shell 18 with the bottom hoop 26. The top hoop 22 and/or the bottom hoop 26 can be secured to the drum shell 18 by various structures known to those skilled in the art, such as tension rods (not shown), lugs (not shown), etc.

The stimulus processor 14 processes each stimulus generated by the stimulus generator 17, which in FIG. 1 is one or more drums 12, and converts each stimulus to an electrical input signal (also referred to herein as "input signal"). The stimulus processor 14 then converts each input signal to an output signal. In one embodiment, the stimulus processor 14 includes a microphone 30, a transmitter 32, a receiver 34 and a controller 36. In the embodiment illustrated in FIG. 1, the user plays the drum 12 thereby eliciting stimuli in the form of sounds, vibrations or any other suitable stimuli. The microphone 30 receives and senses the stimuli and converts the stimuli to electrical input signals. Any drum(s) 12 can elicit the stimulus that is received by the microphone 30.

In one embodiment, the microphone 30 can be positioned adjacent to and/or can be secured to the drum 12. Alternatively, the microphone 30 can be positioned more remotely from the drum 12. The specific type of microphone 30 that can be used can vary depending upon the design requirements of the drum assembly 10. In one embodiment, the microphone 30 can include a contact microphone. However, other suitable types of microphones 30 can also be utilized. Still alternatively, various types of transducers can be used to sense pressure changes, vibrations, etc. In various non-exclusive alternative embodiments, as used herein, the term "microphone" can also equally include a pressure transducer, an optical sensor, or a separate digital controller. Stated another way, the term microphone 30 herein refers to any device that receive and/or sense the stimulus and convert the stimulus to an electrical input signal.

The transmitter 32 receives the input signals from the microphone 30 and transmits these input signals to the receiver 34. The receiver 34 receives the input signals from the transmitter 32 and then sends the input signals to the controller 36. In certain embodiments, the transmitter 32 can wirelessly transmit the input signals to the receiver 34 in order to effectively electrically isolate the microphone 30 from the receiver 34 and/or the controller 36. In non-exclusive alternative embodiments, the isolation between the microphone 30 and the receiver 34 and/or the controller 36 can be accomplished optically or by using an isolation transformer. Still alternatively, the transmitter 32 can be hard-wired to the receiver 34, or the transmitter 32 can be linked to the receiver via a fiber optic connection, as non-exclusive examples.

The receiver 34 receives the input signals from the transmitter 32 and sends the input signals to the controller 36. In one embodiment, the receiver 34 can be part of and/or integrated as part of the controller 36. Alternatively, the receiver 34 can be a separate unit from the controller 36.

The controller 36 reads the input signals 38 (illustrated in FIG. 2) that are received by the receiver 34 and converts them to output signals 40 (illustrated in FIG. 2), as described herein. The controller 36 also transmits these output signals 40 to the Tesla coil 16. The design of the controller 36 can vary to suit the various requirements of the drum assembly 10. In certain embodiments, the controller 36 utilizes one or more conversion algorithms to convert the input signals 38 to output signals 40. For example, the conversion algorithm can filter out noise or signal-shape the input signals 38 into the output signals 40. In certain embodiments, the input signals 38 can also or alternatively be processed by analog electronics known to those skilled in the art. This can include pre-amplification, buffering and/or filtering, which can reduce overtones and/or high-frequency noise in the input signals 38. For example, by applying a low-pass filter, a more "pure" waveform can be produced allowing for better detection of zero-crossings. This analog processing can also include a volume knob (not shown) and/or overvoltage protection since the dynamic range of a percussive instrument can be relatively large. Alternatively, or in addition, at least some of this analog-type processing can also (or alternatively) be accomplished by a digital stimulus processor (DSP) in the digital domain.

In various embodiments, the controller 36 digitizes the input signals 38 using an analog to digital converter (ADC). This digitization contributes to the formation of an output signal 40 in the form of a signal pulse or a series of signal pulses, as described herein. In certain embodiments, a further DSP can be applied in the digital domain, which can include DC offset removal, low-pass filtering, or any other frequency-shaping techniques known to those skilled in the art. The output signals 40 are then sent by the controller 36 to the Tesla coil 16 for selective firing of a high-voltage signal which eventually results in one or more electrical discharges 37 (also sometimes referred to herein as "lightning" or simply "discharge") by the Tesla coil 16 within the drum interior 28. The connection between the controller 36 and the Tesla coil 16 can be via any suitable hard wiring or cabling, such as a fiber optic cable. Alternatively, the connection between the controller 36 and the Tesla coil 16 can be wireless. The Tesla coil 16 can be powered externally by a typical AC power connection.

Figure 2:
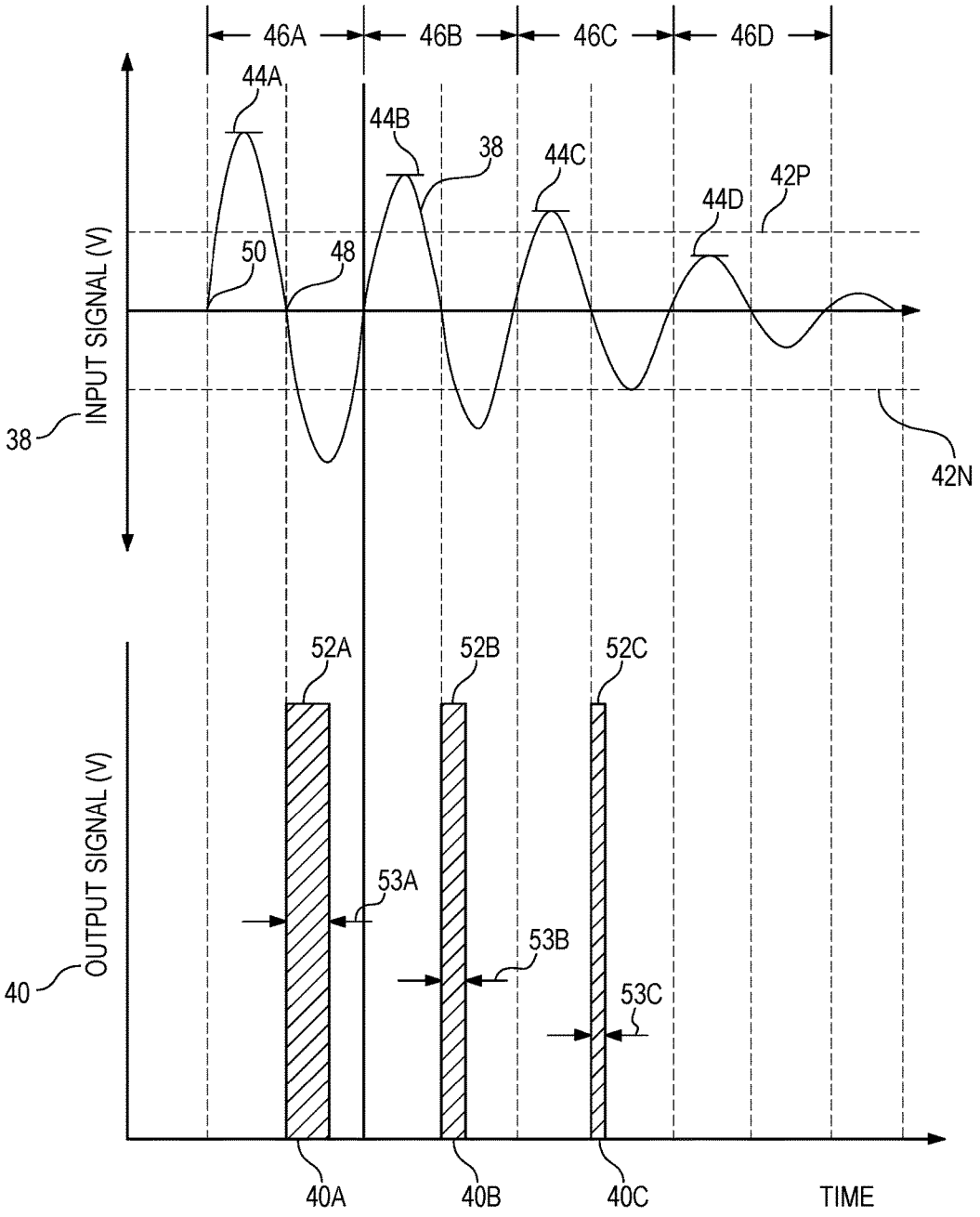
FIG. 2 is a simplified graphical representation of one embodiment of a conversion of an input signal to an output signal using the controller of the drum assembly.

FIG. 2 is a graphical representation of conversion of the analog input voltage signal 38 (sometimes referred to herein simply as "input signal") to the digital output voltage signal 40 (sometimes referred to herein simply as "output signal"). The conversion algorithm used by the controller 36 (illustrated in FIG. 1) can result in a number of different effects upon the Tesla coil 16 (illustrated in FIG. 1). In one embodiment, the conversion algorithm used by the controller 36 can use a thresholding technique to determine whether the drum 12 (illustrated in FIG. 1) has actually been struck. For example, the input signal 38, which is bipolar, is monitored to determine whether it crosses a minimum threshold such as a positive voltage threshold level 42P (although a negative voltage threshold level 42N could alternatively or also be used). In one embodiment, the thresholding inhibits the Tesla coil 16 from randomly discharging due to extraneous noise, and is set to a voltage threshold level 42P (also sometimes referred to herein as "threshold level") that is above a certain noise level.

Either or both of the voltage threshold levels 42P, 42N, can be predetermined by the user. Stated another way, the sensitivity of the firing of the Tesla coil 16 can be tuned by the user by adjusting either or both of the voltage threshold levels 42P, 42N to attain the desired discharge 37 of the Tesla coil 16. For example, the user may want the Tesla coil 16 to discharge only when the user strikes the drum 12 with great force, in which case one or both of the voltage threshold level 42P, 42N can be increased. Alternatively, the user may want the Tesla coil 16 to discharge when the user strikes the drum 12 with much lesser force, in which case one or both of the voltage threshold level 42P, 42N can be decreased.

Further, a maximum input signal amplitude 44A-D of each respective cycle 46A-D of the input signal 38 can be constantly or periodically monitored. Tracking of the maximum input signal amplitude 44A-D of the input signal 38 allows the discharge of the Tesla coil 36 to be modulated by the playing intensity (dynamics) of the user of the drum 12. In the embodiment illustrated in FIG. 2, upon a positive-to-negative zero crossing 48 (one representative positive-to-negative zero crossing 48 is illustrated in FIG. 2), the Tesla coil 16 discharges. Alternatively, the Tesla coil 16 can be set to discharge at a time different than the positive-to-negative zero crossing 48, such as a negative-to-positive zero crossing 50 or any other time during the cycle 46A-D.

In the embodiment illustrated in FIG. 2, the maximum input signal amplitude 44A exceeds the positive threshold level 42P during cycle 46A. As a result, in this embodiment, the output signal 40A for this cycle 46A is elicited having an output amplitude 52A. Further, the maximum input signal amplitudes 44B, 44C, also exceed the positive threshold level 42P during cycles 46B, 46C, respectively. As a result, output signals 40B, 40C, are elicited having output amplitudes 52B, 52C, respectively. However, the maximum input signal amplitude 44D does not exceed the positive threshold level 42P during cycle 46D. As a result, no output signal for this cycle 46D is elicited, and the Tesla coil 16 does not discharge. In an alternative embodiment, thresholding is not utilized so that essentially all input signals 38 result in eliciting output signals 40, at least to some extent.

In this embodiment, a pulse width 53A-53C for each of the respective output signals 40A-40C, is correlative to the maximum input signal amplitude 44A-44C, respectively. For example, because the maximum input signal amplitude 44A is greater than the maximum input signal amplitude 44B, the pulse width 53A of the output signal 40A is greater than the pulse width 53B of the output signal 40B. Somewhat similarly, because the maximum input signal amplitude 44B is greater than the maximum input signal amplitude 44C, the pulse width 53B of the output signal 40B is greater than the pulse width 53C of the output signal 40C. In general, the greater the pulse width 53A-53C of the output signal 40, the greater the current generated by the Tesla coil 16, and the greater the intensity of the discharge 37 of the Tesla coil 16. It is recognized that the intensity of the discharge 37 of the Tesla coil 16 can further be modulated by modulating the time of the pulse widths 53A-53C of the output signal 40 and/or the frequency of the pulses of the output signal 40.

In general, the controller 36 can process additional user information via buttons, switches and potentiometers (not shown). The potentiometers allow the user to adjust relevant parameters of the input signal 38 to impact or influence the character of the output signal 40, such as threshold level, duration (pulse width), frequency and sonic characteristics. For example, the output signal 40 can fire at some multiple or sub-multiple of the frequency of the input signal 38 to change the sound characteristics of the discharge 37 of the Tesla coil 16. For instance, if a fundamental (dominant) frequency read from the drum 12 is F, firing at every positive and negative zero crossing 48, 50, would result in an output frequency of 2F. If firing only happens on the positive zero crossings 48 or the negative zero crossings 50, the output pulse frequency would be F, which would be substantially similar or identical to the frequency of the drum 12. More advanced processing, such as only firing on every other or every third, etc., positive zero crossing 48 or negative zero crossing 50 would result in an output frequency of the Tesla coil 16 of F/2 or F/3, etc., which would create a sub-octave or other harmonics below the original frequency F of the drum 12.

The conversion algorithm used by the controller 36 to generate the output signals 40 can be relatively complex in order to provide a substantially synchronous strike of the drum 12 with discharge 37 from the Tesla coil 16. Further, the conversion algorithm used by the controller 36 can cause the Tesla coil 16 to respond fundamentally differently at different playing volumes and rates, or respond to longer term patterns, such as an increase in drumming intensity over time, as one non-exclusive example. Further, the conversion algorithm can be tuned to cause a time shift in the output signals 40, to either be substantially synchronous with the timing of the input signals 38, or to be delayed following the input signals 38. It is understood that the conversion algorithm(s) can be "tuned" to generate many different effects of the discharge of the Tesla coil 16, and that the foregoing description is not intended to be limiting in any manner to the types of effects that can be generated by the Tesla coil 16. It is further understood that those skilled in the art of conversion of analog signals to digital signals can further manipulate such conversion to achieve any desired result for the timing, intensity, tuning, duration, etc., of the discharge 37 of the Tesla coil 16.

Further, in certain embodiments, during discharge 37 of the Tesla coil 16, the conversion algorithm of the controller 36 can incorporate or otherwise cause a brief delay of further signal conversion during this relatively short period of time. With this design, the relatively loud discharge event of the Tesla coil 16 will not generate further stimuli that are received by the microphone 30, which may otherwise potentially result in the formation of a run-away positive feedback loop.

Referring back to FIG. 1, the Tesla coil 16 receives the output signal 40 from the controller 36 and then selectively generates a high-voltage signal that travels to the drum interior 28 in a substantially controlled manner. Once inside the drum interior 28, a visual electrical discharge 37 occurs in the drum interior 28 of the drum 12. As used herein, the term "Tesla coil" 16 can include any suitable form of induction coil that produces high-frequency alternating currents, and/or any suitable type of electrical resonant transformer, oscillation transformer or radio-frequency transformer circuits that product high-voltage, low-current, high-frequency alternating currents. Importantly, the drum interior 28 that ultimately receives the discharge 37 from the Tesla coil 16 may or may not be part of the drum 12 that elicited the stimulus. For example, the drum 12 that elicits the stimulus can be the same drum 12 or a different drum 12 (or another external stimulus generator 17) than that which receives the discharge 37 from the Tesla coil 16.

In the embodiment illustrated in FIG. 1, the Tesla coil 16 includes a secondary coil 54 and a top load 56 that is coupled to the secondary coil 54. The top load 56 acts as a capacitor from which the high-voltage signal originates. The shape of the top load 56 can vary. In one embodiment, the top load 56 can have a toroidal configuration. However, other configurations or geometries can be used for the top load 56. In an alternative embodiment, the top load 56 can be omitted entirely. Still alternatively, the top load 56 can be in the form of a relatively simple coupler (not shown), i.e. a screw, bolt, or other small conductor or capacitor, which would normally secure top load 56 to the secondary coil 54.

In the embodiment illustrated in FIG. 1, drum assembly 10 also includes a discharge distribution assembly 57. The discharge distribution assembly 57 provides a current path for the discharge 37 from the Tesla coil 16. The design of the discharge assembly 57 can vary to suit the design requirements of the drum assembly 10. In one embodiment, the discharge distribution assembly 57 can include one or more of a discharge router 58, a router aperture 60, a router guide 62, a discharge electrode 64, one or more discharge targets 65 and a ground return line 68.

The discharge router 58 routes a high-voltage signal from the Tesla coil 16 is to the drum interior 28 of the drum 12. In one embodiment, the discharge router 58 can include a high-voltage line or cable that extends between the top load 56 (or secondary coil 54 in embodiments that do not include a top load 56) of the Tesla coil 16 and the drum interior 28 of the drum 12. However, because the high-voltage signal from the Tesla coil 16 will seek electrical ground very aggressively, in one embodiment, the discharge router 58 can include a high-voltage cable (such as an x-ray cable, as one non-exclusive example) which can include a live center electrical conductor (not shown) and a ground-return outer sheath (not shown). With this design, the high-voltage signal from the Tesla coil 16 can be accurately directed or "piped" to the drum interior 28. Alternatively, other types of discharge routers 58 can be used that increase the likelihood that the high-voltage signal from the Tesla coil 16 remains substantially within the discharge router 58 until the high-voltage signal reaches the drum interior 28.

In one embodiment, the Tesla coil 16 can be enclosed within a protective enclosure (not shown) that inhibits extraneous discharges 37 from emanating directly from the Tesla coil 16 itself and not through the discharge router 58 to the drum interior 28. The protective enclosure can be formed from any type of relatively non-conductive material, such as an acrylic material or other suitable materials.

The router aperture 60 provides an opening through the drum shell 18 for the discharge router 58 to extend into the drum interior 28.

The router guide 62 guides the discharge router 58 into the drum interior 28 of the drum 12. The router guide 62 can be a substantially cylindrical (or other suitable configuration) sleeve-type of structure that guides the discharge router 58 to a desired location within the drum interior 28. In one embodiment, the router guide 62 guides the discharge router 58 to the discharge electrode 64 at or near a geometric center of the drum interior 28. Alternatively, the discharge electrode 64 can be positioned away from the geometric center of the drum interior 28.

The discharge electrode 64 can be any suitable structure that serves as an endpoint of the discharge router 58, and a point from which the discharge 37 of the Tesla coil first becomes visible within the drum interior 28. For example, in one embodiment, the discharge electrode 64 can include a conductive fastener, such as a small metallic stainless steel, knob-type structure. However, any suitable conductive structure formed from a suitable material can be used for the discharge electrode 64.

The drum assembly 10 can also include one or more discharge targets 65 that are positioned within the drum interior 28 of the drum 12. The sizes, quantity, orientation, shapes and positioning of the discharge targets 65 can be varied to suit the design requirements of the drum assembly 10. The discharge targets 65 can be formed from any material(s) that attract the discharge 37 from the discharge electrode 64. For example, in various non-exclusive embodiments, the discharge targets 65 can be formed from stainless steel or nichrome.

In one embodiment, two or more of the discharge targets 65 can be positioned within the drum interior 28 substantially equidistant from the discharge electrode 64. Alternatively, all of the discharge targets 65 are positioned within the drum interior 28 substantially equidistant from the discharge electrode 64. With this design, the discharge 37 from the Tesla coil 16 randomly or indiscriminately strikes the various discharge targets 65 in a somewhat haphazard manner, rather than repeatedly striking the same discharge target 65, thereby providing observers with a better visual experience. Still alternatively, the discharge targets 65 are randomly or semi-randomly positioned within the drum interior 28. In various embodiments, the discharge targets can be spread around the drum interior 28 to cause longer distance discharge patterns with each discharge 37 of the Tesla coil 16. In one embodiment, one or more of the discharge targets 65 can be coupled to the ground return line 68.

The ground return line 68 can include various electronic elements that choke or resist the discharge 37 during the return to the Tesla coil 16 through the ground return line 68. As non-exclusive examples, the ground return line 68 can be wrapped around a ferrite core (not shown), and/or various appropriately-sized resistors, capacitors and/or inductors can be added to the ground return line 68, and/or any other method known to those skilled in the electrical industry. Alternatively, the ground return line 68 can be omitted altogether. Still alternatively, the ground return line can be incorporated as part of the discharge router 58.

Although the disclosure provided herein only describes the use of one drum assembly 10, it is recognized that multiple drum assemblies 10 can be utilized simultaneously, with each drum assembly 10 having all of the components described herein, or each drum assembly 10 sharing various components to avoid duplication and allow for greater simplicity.

Figure 3:
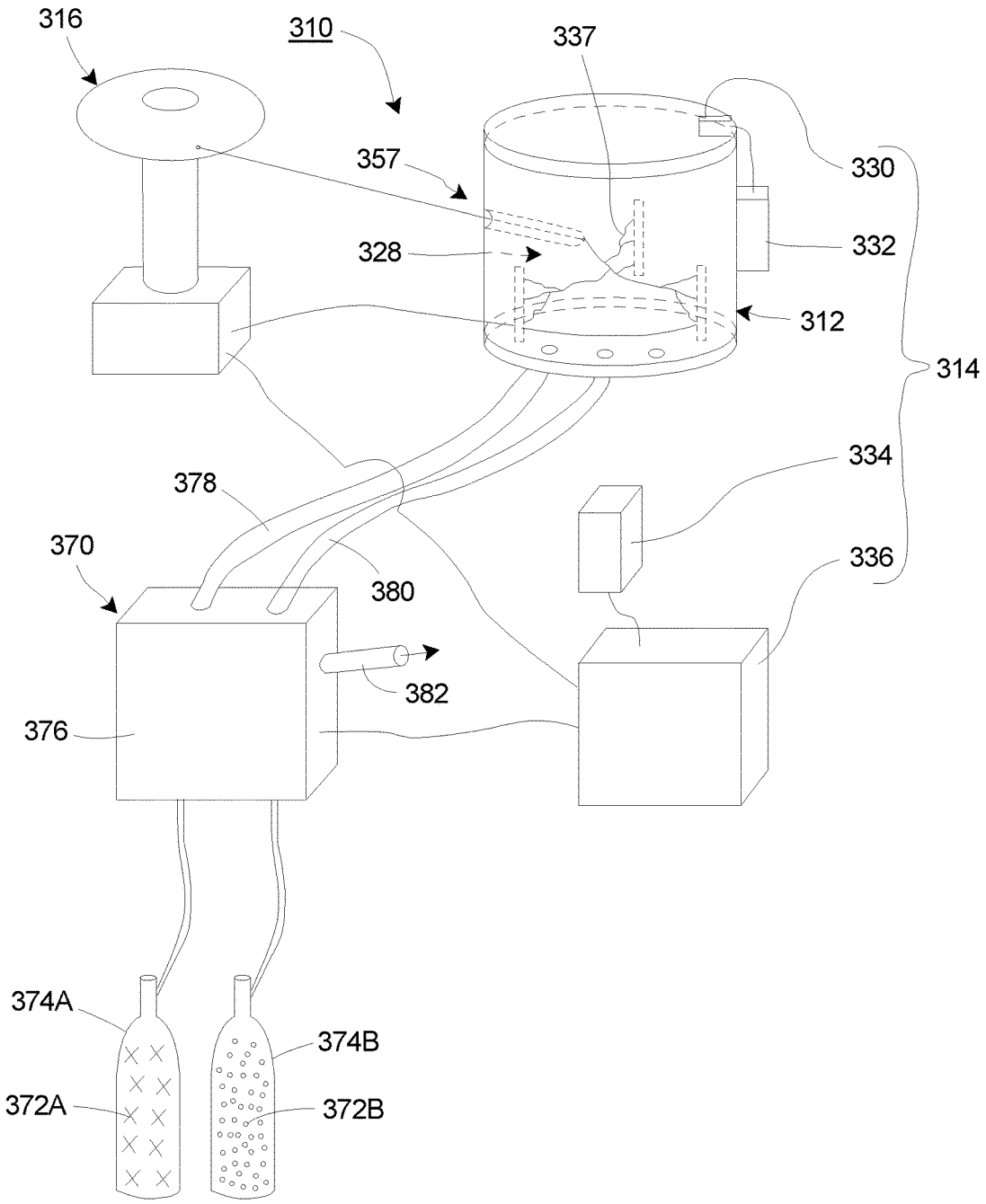
FIG. 3 is a simplified schematic illustration of yet another embodiment of the drum assembly.

FIG. 3 is a simplified schematic illustration of another embodiment of a drum assembly 310. In this embodiment, the drum assembly 310 is substantially similar to the drum assembly 10 previously described. The drum assembly includes a drum 312, a stimulus processor 314, a Tesla coil 316 and a discharge distributor assembly 357. As provided previously, the stimulus processor 314 can include one or more of a microphone 330, a transmitter 332, a receiver 334 and a controller 336 that each functions substantially similarly to those previously described. However, in this embodiment, the drum assembly 310 also includes a fluid assembly 370.

The fluid assembly 370 delivers and/or removes one or more of a first fluid 372A and a second fluid 372B to and from the drum interior 328 of the drum 312. The design of the fluid assembly 370 can vary. In the embodiment illustrated in FIG. 3, the fluid assembly 370 includes one or more fluids 372A, 372B, a first fluid container 374A, a second fluid container 374B, a fluid controller 376, one or more fluid delivery lines 378, and one or more fluid removal lines 380. Although two fluids 372A, 372B and two fluid containers 374A, 374B are illustrated in FIG. 3, it is understood that any other suitable number of fluids and fluid containers can be utilized, whether greater or fewer than two.

In various non-exclusive embodiments, the fluids 372A, 372B can include one or more of air, nitrogen, and noble gases such as helium, neon, argon, krypton and xenon. Alternatively, other suitable gases or mixtures of any suitable gases can likewise be utilized.

The fluid controller 376 controls the dispensing of the one or more fluids 372A, 372B, to the drum interior 328 via the fluid delivery line(s) 378 (only one fluid delivery line 378 is illustrated in FIG. 3). In one embodiment, the fluid controller 376 can be separate from the controller 336. However, in an alternative embodiment, the fluid controller 376 can be part of the controller 336. In one embodiment, the fluid controller 376 can include one or more of a solenoid (not shown), regulators (not shown), mixers (not shown), flow control hardware (not shown) and/or software (not shown) that controls which fluid 372A, 372B is to be dispensed and delivered to the drum interior 328, the duration of dispensation, the quantity of fluid(s) 372A, 372B, to be dispensed, and the mixture of fluids 372A, 372B, if applicable.

In the embodiment illustrated in FIG. 3, the controller 336 provides various commands to the fluid controller 376. These commands can be based on the desired effects from the user (drummer or other personnel), e.g., interactive control by the user, or based on an automated, predetermined or preprogrammed schedule for fluid delivery to the drum interior 328. In one embodiment, the controller 336 can be programmed to precisely deliver specific fluids 372A, 372B to the drum interior 328 in order to elicit different visual effects upon discharge 337 of the Tesla coil to within the drum interior 328, based on the type of fluid being delivered, as described herein.

In one embodiment, the fluid delivery line 378 extends from the fluid controller 376 to within the drum interior 328. The fluid removal line 380 can extend from the drum interior 328 back to the fluid controller 376 so that the fluid controller 376 can actively remove the fluids 372A, 372B from the drum interior 328, such as by a vacuum source (not shown), for example. The fluids 372A, 372B that are removed from the drum interior 328 can then be expelled as exhaust via an exhaust line 382 to a safe location. Alternatively, the fluid from the drum interior 328 can be displaced out of the drum interior 328 via the fluid removal line 380 as a result of the delivery of additional fluid into the drum interior 328.

Figures 4, 6:
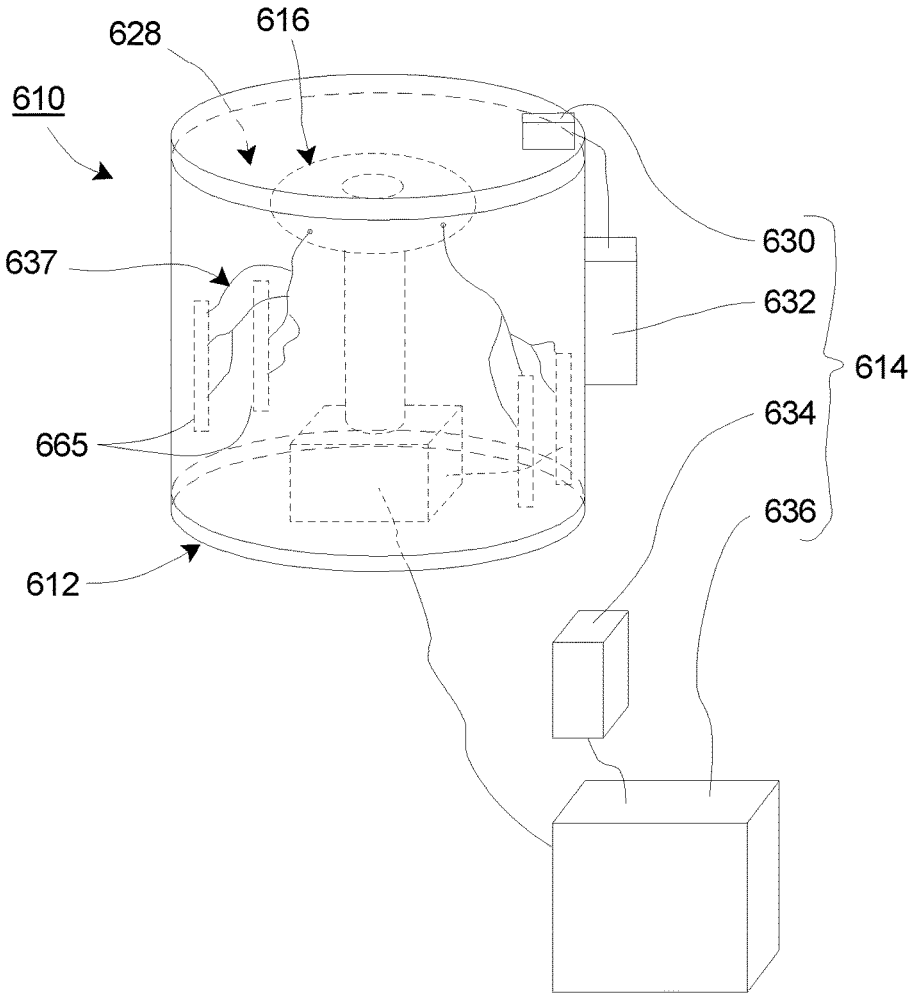
FIG. 4 is a table representing various combinations of fluids and resulting colors of an electrical discharge a Tesla coil within a portion of the drum assembly.
FIG. 6 is a simplified schematic illustration of yet another embodiment of the drum assembly.

FIG. 4 is a table showing various fluids and resulting colors of an electrical discharge a Tesla coil within a portion of the drum assembly 312 (illustrated in FIG. 3). In one embodiment, a specific gas is delivered to the drum interior 328 (illustrated in FIG. 3) immediately prior to and/or during a discharge 337 (illustrated in FIG. 3) from the Tesla coil 316 (illustrated in FIG. 3). Based on the specific fluid delivered to the drum interior, various colors can be achieved. For example, as illustrated in FIG. 4, helium gas will elicit a somewhat pink color during discharge 337 of the Tesla coil 316 into the drum interior 328. Neon gas will elicit a somewhat red color during discharge 337 of the Tesla coil 316 into the drum interior 328. Argon gas will elicit a somewhat purple color during discharge 337 of the Tesla coil 316 into the drum interior 328. Krypton gas will elicit a somewhat blue color during discharge 337 of the Tesla coil 316 into the drum interior 328. Xenon gas will elicit a somewhat purple/whitish color during discharge 337 of the Tesla coil 316 into the drum interior 328. Various combinations of these fluids will yield other colors. For example, mixing xenon with nitrogen in a certain proportion can elicit a somewhat green color during discharge of the Tesla coil 316 into the drum interior 328. It is understood that these gases and corresponding colors are provided as representative examples only, and are not intended to limit the types of fluids that can be used with the drum assemblies described herein.

Figure 5A:
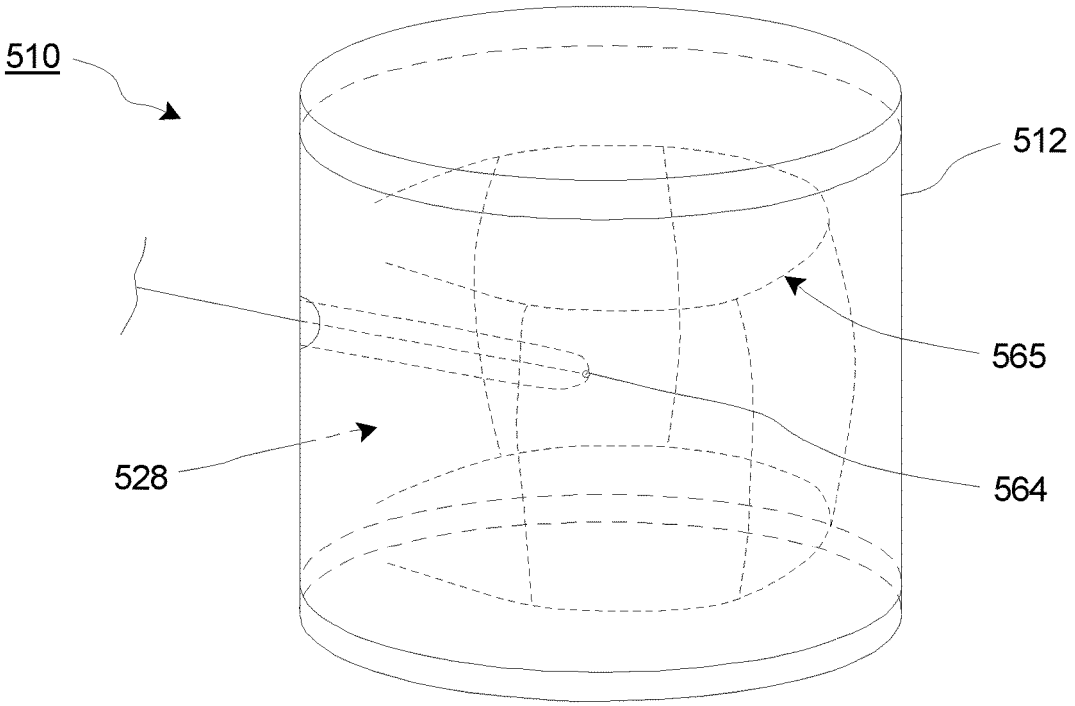
FIG. 5A is a perspective view of one embodiment of the drum of the drum assembly.

FIG. 5A is a perspective view of one embodiment of the drum 512 of the drum assembly 510. In this embodiment, the drum assembly 510 includes a discharge target 568 positioned within the drum interior 528 of the drum 512. In the embodiment illustrated in FIG. 5A, the discharge target 568 can be one continuous structure rather than a plurality of separate, discontinuous discharge targets as previously described. The configuration of the discharge target 568 can vary. In one embodiment, each point along the discharge target 568 can be approximately equidistant from the discharge outlet 566. The discharge target 568 can be secured to any suitable portion of the drum 512 within the drum interior 528.

Figure 5B:
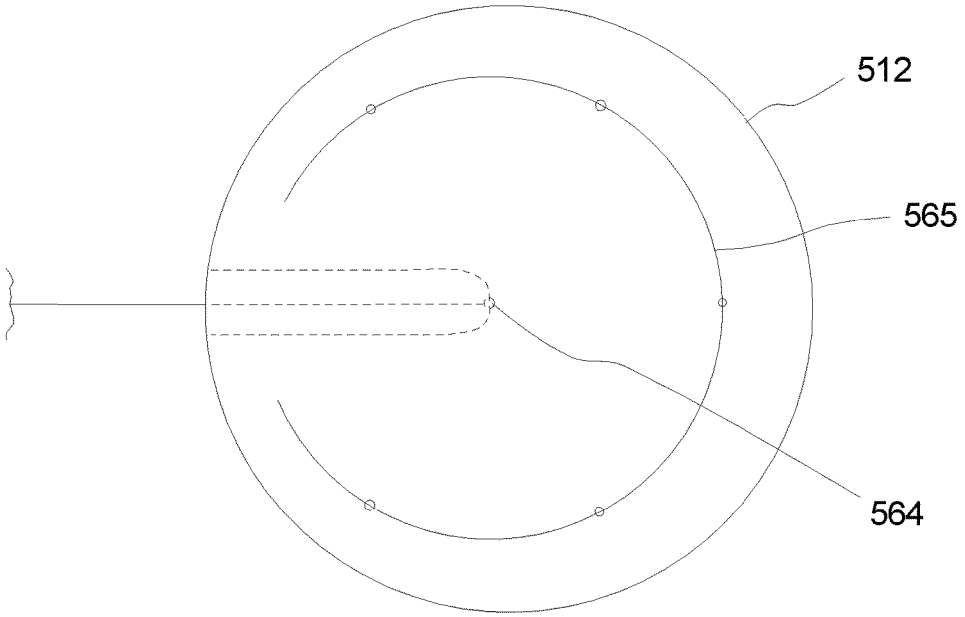
FIG. 5B is a top view of the drum illustrated in FIG. 5A.

FIG. 5B is a top view of the drum 512 illustrated in FIG. 5A. As illustrated in this embodiment, the discharge target 568 forms a portion of a circle having the discharge outlet 566 substantially centrally positioned so that the discharge 37 from the Tesla coil 16 indiscriminately extends towards varying locations on the discharge target 568. With this design, the observer is provided with a more diverse visual effect and experience.

FIG. 6 is a simplified schematic illustration of another embodiment of the drum assembly 610. In this embodiment, the drum assembly 610 is substantially similar to the drum assembly 10 previously described. The drum assembly includes a drum 612, a stimulus processor 614 and a Tesla coil 616. The stimulus processor 614 converts each input signal 38 (illustrated in FIG. 2) to an output signal 40 (illustrated in FIG. 2). The stimulus processor 614 can include one or more of a microphone 630, a transmitter 632, a receiver 634 and a controller 636 that each functions substantially similarly to those previously described. However, in this embodiment, the Tesla coil 616 is positioned within the drum interior 628. In the embodiment illustrated in FIG. 6, because the Tesla coil 616 is positioned within the drum interior 628, the need for the discharge router 58 (such as that illustrated in FIG. 1) is obviated. The discharge 637 of the Tesla coil can occur without the use of the discharge router 58, and the discharge 637 can occur directly from the Tesla coil 616 to the one or more discharge targets 658.

Figure 7:
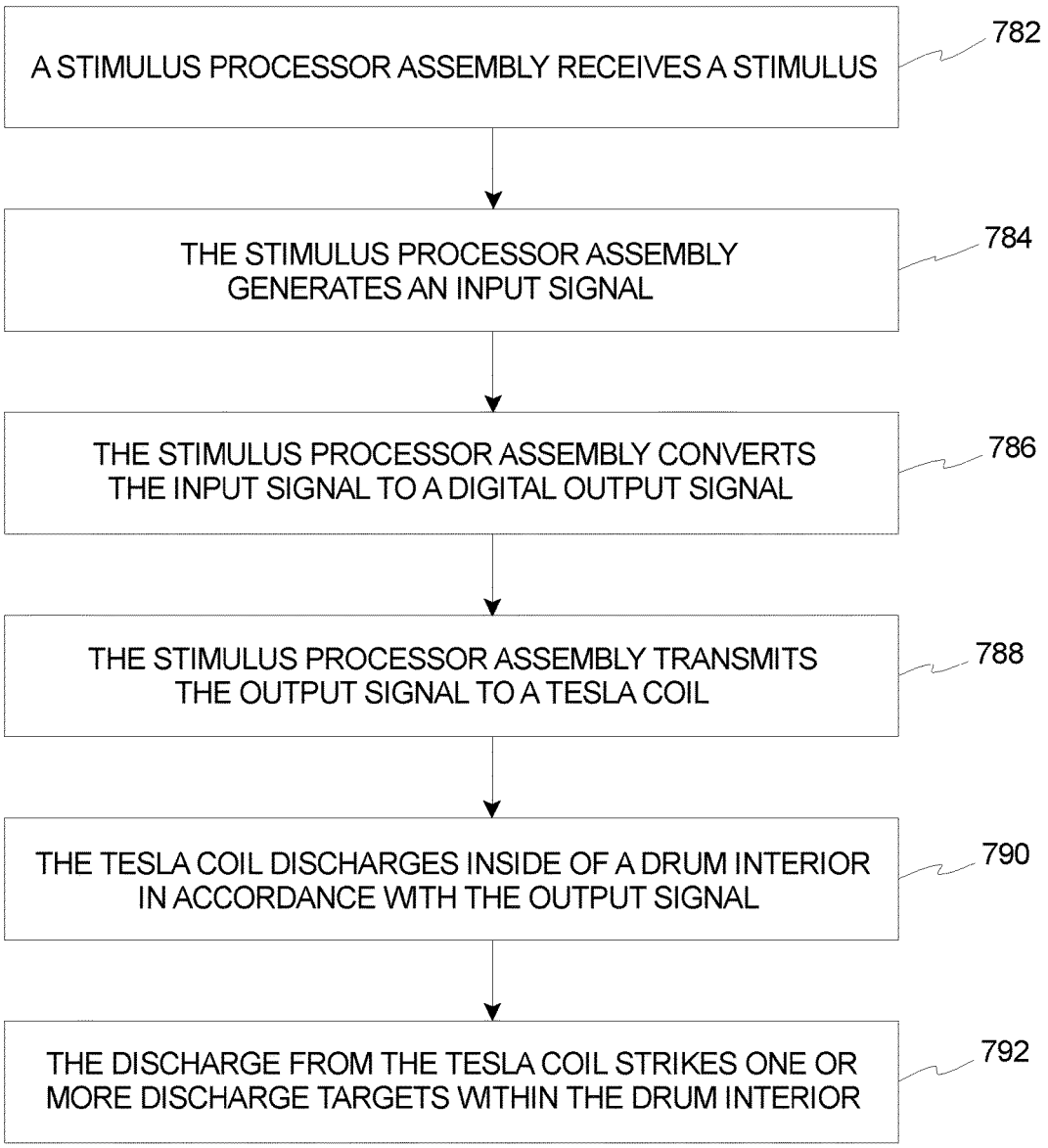
FIG. 7 is a flow chart illustrating one embodiment of a method for discharging electricity from a Tesla coil within a drum assembly.

FIG. 7 is a flow chart illustrating one embodiment of a method for discharging electricity from a Tesla coil within a drum assembly. In one embodiment, the method includes one or more of the following steps.

In step 782, a stimulus is received by a stimulus processor assembly. As provided herein, the stimulus can be from a user striking one or more drums, or the stimulus can be from an external source such as a MIDI signal or input, as one non-exclusive example.

In step 784, the stimulus processor assembly generates an input signal. This signal can be an analog signal, e.g., from a drum, or a digital signal, e.g., a MIDI input, as non-exclusive examples.

In step 786, the stimulus processor assembly converts the input signal to a digital output signal.

In step 788, the stimulus processor assembly transmits the output signal to a Tesla coil, which can be accomplished using an optical fiber and drive circuitry.

In step 790, the Tesla coil generates a high-voltage signal which is controlled by the output signal. In one embodiment, the high-voltage signal is transmitted and/or routed to a drum interior of the drum via a discharge router. Once inside the drum interior, the high-voltage signal discharges within the drum interior. Alternatively, the Tesla coil is positioned within a drum interior of the drum, and discharges directly within the drum interior.

In step 792, the discharge from the Tesla coil strikes one or more discharge targets within the drum interior.

It is understood that although a number of different embodiments of the drum assembly 10 have been illustrated and described herein, one or more features of any one embodiment can be combined with one or more features of one or more of the other embodiments, provided that such combination satisfies the intent of the present invention.

While a number of exemplary aspects and embodiments of the drum assembly 10 have been discussed above, those with skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A drum assembly, comprising:
a drum including a drum shell that at least partially defines a drum interior;
a stimulus processor assembly that (i) receives a stimulus, (ii) generates an input signal, and (iii) converts the input signal to an output signal; and
a Tesla coil that receives the output signal from the stimulus processor assembly, the Tesla coil emitting an electrical discharge in response to the output signal, the electrical discharge occurring at least partially within the drum interior.

2. The drum assembly of claim 1 wherein the stimulus processor assembly includes a controller that converts the input signal to the output signal using a conversion algorithm.

3. The drum assembly of claim 1 wherein the Tesla coil is positioned within the drum interior.

4. The drum assembly of claim 1 wherein the Tesla coil is positioned outside of the drum interior.

5. The drum assembly of claim 4 further comprising a discharge router that routes at least a portion of the electrical discharge from the Tesla coil to the drum interior.

6. The drum assembly of claim 1 wherein the Tesla coil emits the electrical discharge only when the input signal has a voltage amplitude that exceeds a predetermined threshold level.

7. The drum assembly of claim 6 wherein the electrical discharge has an intensity that is correlative to the decibel level of the stimulus.

8. The drum assembly of claim 1 wherein the stimulus is generated by one or more drums.

9. The drum assembly of claim 1 wherein the stimulus is generated remotely from the drum.

10. The drum assembly of claim 9 wherein the stimulus is generated by a musical instrument digital interface input.

11. The drum assembly of claim 1 wherein the electrical discharge has an intensity that is correlative to at least one of a pulse width and a frequency of the output signal.

12. The drum assembly of claim 1 wherein the electrical discharge is emitted substantially entirely within the drum interior.

13. The drum assembly of claim 1 wherein the stimulus processor assembly includes a transducer.

14. The drum assembly of claim 1 further comprising a discharge target positioned within the drum interior, the discharge target being configured to be struck by at least a portion of the electrical discharge.

15. The drum assembly of claim 1 wherein the input signal is an analog signal, and the output signal is a digital signal.

16. A method comprising the steps of:
generating an input signal from a stimulus with a stimulus processor assembly;
converting the input signal to an output signal with the stimulus processor assembly;
transmitting the output signal to a Tesla coil; and
emitting an electrical discharge from the Tesla coil at least partially into a drum interior of a drum.

17. The method of claim 16 wherein the step of converting includes using a conversion algorithm.

18. The method of claim 16 wherein the step of emitting includes positioning the Tesla coil outside of the drum interior.

19. The method of claim 16 further comprising the step of generating the stimulus with a drum.

20. A drum assembly, comprising:

a drum including a drum shell that at least partially defines a drum interior;

a stimulus processor assembly that (i) receives a stimulus, (ii) generates an input signal, and (iii) converts the input signal to a digital output signal only when the input signal exceeds a predetermined voltage amplitude; and a Tesla coil that is positioned outside of the drum interior, the Tesla coil receiving the output signal from the stimulus processor assembly, the Tesla coil emitting an electrical discharge in response to the output signal, the electrical discharge occurring at least partially within the drum interior.

* * * * *